US009567844B2

(12) United States Patent
Mauldin et al.

(10) Patent No.: US 9,567,844 B2
(45) Date of Patent: Feb. 14, 2017

(54) ANALYSIS OF DRILLSTRING DYNAMICS USING ANGULAR AND LINEAR MOTION DATA FROM MULTIPLE ACCELEROMETER PAIRS

(71) Applicants: Charles L. Mauldin, Spring, TX (US); Jacob Hill, Houston, TX (US); Liam Lines, Houston, TX (US)

(72) Inventors: Charles L. Mauldin, Spring, TX (US); Jacob Hill, Houston, TX (US); Liam Lines, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 629 days.

(21) Appl. No.: 14/050,664

(22) Filed: Oct. 10, 2013

(65) Prior Publication Data

US 2015/0101865 A1 Apr. 16, 2015

(51) Int. Cl.
*E21B 44/00* (2006.01)
*E21B 47/024* (2006.01)

(52) U.S. Cl.
CPC ..... *E21B 44/00* (2013.01); *E21B 47/024* (2013.01)

(58) Field of Classification Search
CPC ..... E21B 47/09; E21B 47/024
See application file for complete search history.

(56) References Cited

U.S. PATENT DOCUMENTS 3,713,500 A 1/1973 Russell
3,841,420 A 10/1974 Russell
4,958,125 A 9/1990 Jardine et al.
5,226,332 A 7/1993 Wassell
5,501,285 A 3/1996 Lamine et al.
5,738,178 A 4/1998 Williams et al.
5,864,058 A 1/1999 Chen
6,166,654 A 12/2000 Van Den Steen
6,205,851 B1 3/2001 Jogi
6,518,756 B1 2/2003 Morys et al.
6,571,870 B2 6/2003 Zheng et al.
6,585,061 B2 7/2003 Radzinski et al.
7,058,512 B2 6/2006 Downtown
7,313,480 B2 12/2007 Chen et al.
(Continued)

FOREIGN PATENT DOCUMENTS

EP 0 443 689 A2 2/1991
EP 1253285 A2 10/2002
(Continued)

OTHER PUBLICATIONS

First Examination Report in UK Appl. GB1417878.4, dated Feb. 5, 2015.

(Continued)

*Primary Examiner* — Robert E Fuller
(74) *Attorney, Agent, or Firm* — Blank Rome LLP

(57) ABSTRACT

Downhole drilling vibration analysis uses angular and linear motion data on a drilling assembly. During drilling operations, pairs of accelerometers measure the angular and linear motion of the drilling assembly. Processing circuitry is operatively coupled to the accelerometer pairs and is configured to determine type and severity of vibrations occurring during drilling based on the angular and linear motion data. Drilling operations can then be modified to overcome or mitigate the detrimental vibrations.

35 Claims, 6 Drawing Sheets

(56) References Cited

U.S. PATENT DOCUMENTS

| | | | | |
|---|---|---|---|---|
| 8,016,050 | B2 | 9/2011 | Teodorescu | |
| 8,028,764 | B2 | 10/2011 | Teodorescu | |
| 8,100,196 | B2 | 1/2012 | Pastusek et al. | |
| 8,131,494 | B2 | 3/2012 | Georgi et al. | |
| 2004/0245017 | A1 | 12/2004 | Chen et al. | |
| 2006/0006000 | A1* | 1/2006 | Weston | E21B 7/04 175/45 |
| 2006/0271299 | A1 | 11/2006 | Ward et al. | |
| 2007/0107937 | A1* | 5/2007 | Sugiura | E21B 7/062 175/45 |
| 2008/0294344 | A1 | 11/2008 | Sugiura | |
| 2009/0138242 | A1 | 5/2009 | Pabon | |
| 2009/0194332 | A1 | 8/2009 | Pastusek et al. | |
| 2009/0222209 | A1 | 9/2009 | Morys | |
| 2010/0082256 | A1 | 4/2010 | Mauldin et al. | |
| 2010/0097890 | A1 | 4/2010 | Sullivan et al. | |
| 2011/0077924 | A1 | 3/2011 | Ertas et al. | |
| 2011/0108327 | A1 | 5/2011 | Farley et al. | |
| 2011/0147083 | A1* | 6/2011 | Mauldin | E21B 47/024 175/50 |
| 2011/0214878 | A1 | 9/2011 | Bailey et al. | |
| 2012/0222900 | A1* | 9/2012 | Rodney | E21B 44/00 175/56 |
| 2013/0092439 | A1 | 4/2013 | Mauldin et al. | |

FOREIGN PATENT DOCUMENTS

| | | | |
|---|---|---|---|
| WO | 0235048 | A1 | 5/2002 |
| WO | 02/68995 | A2 | 6/2002 |
| WO | 2004/065749 | A2 | 8/2004 |
| WO | 2006089258 | | 8/2006 |
| WO | 2013/056152 | A1 | 4/2013 |
| WO | 2014/165389 | A1 | 10/2014 |

OTHER PUBLICATIONS

Green, J. et al., "New iMEMS(R) Angular-Rate-Sensing Gyroscope," Analog Dialogue, dated 2003.

MacPherson, John, "The Science of Stick-Slip," IADC Stick-Slip Mitigation Workshop, Jul. 15. 2010.

Greenberg, J., "Weatherford Sensors Track Vibration to Increase ROP, Temperature CHnage for Early Kick Detection," Mar./Apr. 2008. 2 pgs.

Weatherford International Ltd., "HEL™ MWD System—Environmental Severity Measurement (ESM™) Sensor," © 2006, obtained from www.weatherford.com, 3 pgs.

Drilling Contractor, "Innovating While Drilling," Mar./Apr. 2008, 2 pgs.

Abdulgalil, F., et al, "Nonlinear Friction Compensation Design for Suppressing Stick Clip Oscillations in Oilwell Drillstrings," © 2004 IFAC, 5 pgs.

Sugiura, et al, "Detect Near-Bit Vibration in Real Time," Jul. 2008 E&P, obtained from www.EPmag.com, 5 pgs.

Navarro-Lopez, E.M., et al., "Modelling & Ananlysis of Stick-Slip Behaviour in a Drillstring under Dry Friction," Congreso Anual de la Amca 2004, 6 pgs.

Navarro-Lopez, E.M., et al., "Practical Approach to Modelling & Controlling Stick-Slip Oscillations in Oilwell Drillstrings," Proceedings of 2004 IEEE International Conference on Control Applications, Taipei, Taiwan, Sep. 2-4, 2004, 7 pgs.

Baker-Hughes, "Advancing Reservoir Performance: Overview-Vibration/Stick-Slip Monitoring (VSS®)," © 2009, obtained from www.bakerhughesdirect.com.

Silveria, M., et al., "Low dimensional models for stick-slip vibration of drill-strings," Journal of Physics: Conference Series 181 (2009) 012056 © 2009 IOP Publishing, 8 pgs.

Leine, R.I., et al., "Stick-Slip Whirl Interaction in Drillstring Dynamics," Journal of Vibrations and Acoustics © 2002 by ASME Apr. 2002, vol. 124, 12 pgs.

Leine, R.I., et al., "Stick-Slip Whirl Interaction in Drillstring Dynamics," Eidenhoven University of Technology, undated, 10 pgs.

Khulief, Y.A., et al., "Vibration analysis of drillstrings with self-excited stick-slip oscillations," Journal of Sound and Vibration 299 (2007) 540-558, obtained from www.elsevier.com/locate/jsvi, 19 pgs.

Sugiura, M., et al., "Automated Drilling and Real-Time Drilling Process Monitoring Optimize RSS Underreamer Technology," obtained from www.drillingcontractor.org, generated on Oct. 21, 2009, 3 pgs.

Richard, T., et al.,"A simplified model to explore the root cause of stick-slip vibrations in drilling systems with drag bits," Journal of Sound and Vibration 305 (2007) 432-456, obtained from www.elsevier.com/locate/jsvi, 25pgs.

Schlumberger, "Shock and vibration mitigation," Jul. 2007, 1 pg.

Richard, T., et al. "Self-Excited Stick-Slip Oscillations of Drag Bits," XXI ICTAM, Aug. 15-21, 2004, Warsaw, Poland, 2 pgs.

Sugiura, J., "The Use of the Near-bit Vibration Sensor While Drilling Leads to Optimized Rotary-Steerable Drilling in Push-and Point-the-Bit Configurations," © 2008, Society of Petroleum Engineers, SPE 115572, 10 pgs.

Warren, T.M., et al. "Torsional Resonance of Drill Collars with PDC Bits in Hard Rock," © 1998, Society of Petroleum Engineers, SPE 49204, 13 pgs.

Khulief,Y.A., et al., "Finite element dynamic analysis of drillstrings," Finite Elements in Analysis and Design 41 (2005) 1270-1288, obtained from www.elsevier.com/locate/finel, 19 pgs.

International Search Report and Written Opinion received in corresponding PCT Patent Application No. PCT/US2012/060098, mailed Jan. 23, 2013.

First Office Action in counterpart Canadian Appl. 2,866,567, dated Nov. 10, 2015.

Second Examination Report in counterpart UK Appl. GB 1417878A, dated Mar. 22, 2016.

Second Office Action in counterpart Canadian Appl. 2,866,567, dated Oct. 18, 2016, 3-pgs.

* cited by examiner (Stick-Slip)

(Whirl)

ANALYSIS OF DRILLSTRING DYNAMICS USING ANGULAR AND LINEAR MOTION DATA FROM MULTIPLE ACCELEROMETER PAIRS

BACKGROUND

To explore for oil and gas, operators drill a well by rotating a drillstring having a drill bit and drill collars to bore through a formation. In a common form of drilling called rotary drilling, a rotary table or a top drive rotates a drillstring, which has a bottom hole assembly (BHA). The drillstring is rotated with increased weight to provide necessary weight on the assembly's bit to penetrate the formation. During the drilling operation, however, vibrations occurring in the drillstring can reduce the assembly's rate of penetration (ROP). Therefore, it is useful to monitor vibration of the drillstring, bit, and BHA and to monitor the drilling assembly's rate of rotation to determine what is occurring downhole during drilling. Based on the monitored information, a driller can then change operating parameters, such as weight on the bit (WOB), drilling collar RPM, and the like, to increase drilling efficiency.

Because the drillstring can be of considerable length, it can undergo elastic deformations, such as twisting, that can lead to rotational vibrations and considerable variations in the drill bit's speed. For example, stick-slip is a severe torsional vibration in which the drillstring sticks for a phase of time as the bit stops and then slips for a subsequent phase of time as the drillstring rotates rapidly. When it occurs, stick-slip can excite severe torsional and axial vibrations in the drillstring that can cause damage. In fact, stick-slip can be the most detrimental type of torsional vibration that can affect a drillstring.

For example, the drillstring is torsionally flexible so friction on the drill bit and drilling assembly as the drillstring rotates can generate stick-slip vibrations. In a cyclic fashion, the bit's rotational speed decreases to zero. Torque on the drillstring increases due to the continuous rotation applied by the rotary table, and the torque accumulates as elastic energy in the drillstring. Eventually, the drillstring releases this energy and rotates at speeds significantly higher than the speed applied by the rotary table.

The speed variations can damage the BHA, the bit, and the like and can reduce the drilling efficiency. To suppress stick-slip and improve efficiency, prior art systems, such as disclosed in EP 0 443 689, have attempted to control the speed imparted at the rig to damp any rotational speed variations experienced at the drill bit. Other systems monitor wear of a drill bit during drilling. For example, two particular examples of systems using multiple accelerometers on a drill bit to monitor wear of the bit are disclosed in U.S. Pat. Nos. 8,016,050 and 8,028,764.

In whirl vibrations (also called bit whirl), the bit, BHA, or the drillstring rotates about a moving axis (precessional movement) at a different rotational velocity with respect to the borehole wall than what the bit would rotate about if the axis were stationary. Forward whirl is when the drilling assembly precesses clockwise about the centerline of the borehole; and backward whirl is when the drilling assembly precesses counter-clockwise about the centerline of the borehole. Thus, in backward whirl, for example, friction causes the bit and BHA to precess around the borehole wall in a direction opposite to the drillstring's actual rotation. For this reason, backwards whirl can be particularly damaging to drill bits. Whirl can be extremely damaging to drilling collars and assemblies due to the high frequency bending stresses induced in the drillstring. These bending loads occur at a multiple of the string rotation rate and thus can be extremely detrimental to fatigue life. Whirl is self-perpetuating once started because radial and tangential acceleration create more friction. Once whirl starts, it can continue as long as bit rotation continues or until some hard contact interrupts it.

As noted above, stick-slip and bit whirl during drilling operations cause inefficiencies and can lead to failure of components downhole. An additional detrimental phenomenon is torsional vibration and torsional resonance of a drillstring or BHA. For example, effects of torsional resonance on drill collars having PDC bits in hard rock are discussed in SPE 49204, by T. M. Warren, et al. and entitled "Torsional Resonance of Drill Collars with PDC Bits in Hard Rock."

When detrimental vibrations occur downhole during drilling, operators want to change aspects of the drilling parameters to reduce or eliminate the vibrations. If left unaddressed, the vibrations will prematurely wear out the bit, damage the BHA, or produce other detrimental effects. Typically, operators change the weight on bit, the rotary speed (RPM) applied to the drilling string, or some other drilling parameter to deal with vibration issues. Thus, the instantaneous diagnosis of detrimental vibrations can enable drilling operations to take timely corrective action to mitigate or stop the vibrations.

Unfortunately, existing data collection may not give a complete understanding of what is occurring to the drilling assembly downhole. Attempts to detect vibrations during drilling have historically used accelerometers in a downhole sensor sub to measure accelerations during drilling and to analyze the frequency and magnitude of peak frequencies detected.

As will be appreciated, the accelerometers in the downhole sensor sub are susceptible to spurious vibrations and can produce a great deal of noise. In addition, some of the mathematical models for processing accelerometer data can involve several parameters and can be cumbersome to calculate in real-time when a drilling operator needs the information the most. Lastly, the processing capabilities of hardware used downhole can be somewhat limited, and telemetry of data uphole to the surface may have low available bandwidth.

Existing systems typically obtain a bias for an accelerometer mounted off axis on a toolstring and subtract that bias as an average from the readings obtained by the accelerometer. During rotational drilling operations, however, the accelerometer conventionally mounted off axis is susceptible to radial and tangential acceleration that cannot be differentiated from true lateral vibrations. Torsional vibrations can occur downhole at such high frequencies that they may not be measurable using conventional data acquisition methods. This makes determining vibration of a downhole tool during drilling operations particularly difficult.

Several solutions to these problems are disclosed in U.S. Pat. Pub. 2013/0092439 and entitled "Analysis of Drillstring Dynamics Using an Angular Rate Sensor," which is incorporated herein by reference in its entirety. In these solutions, an angular rate gyroscope is used off-axis on a tool of a drillstring to directly measure the angular acceleration and angular velocity—components of angular motion—which can then be analyzed to determine the vibration occurring downhole. Although this is effective, operators strive for additional ways to measure angular and linear motion to determine vibrations of a tool downhole during drilling. It is to this end, at least in part, that the subject matter of the present disclosure is directed.

SUMMARY

As noted above, true lateral vibration, angular velocity, and angular accelerations can be useful measurements in downhole MWD/LWD systems to determine drilling efficiency, harmful vibrations, and other information. The teachings of the present disclosure detect and measure detrimental vibrations, such as angular vibration (e.g., torsional vibration) and/or linear vibration (e.g. lateral, axial, or whirl vibration).

Torsional vibration refers to the angular vibration that occurs along the rotational axis in a shaft or the like as it experiences changes in torque. In drilling assemblies, torsional vibration can occur in any of the rotating longitudinal bodies used downhole, such as drillstring, tubular, drill collars, etc. Typical forms of torsional vibration include stick slip and torsional resonance (low and high frequency).

Torsional vibration can create torsional resonance when the vibration reaches a natural frequency of the drillstring or the like. In some instances, the amplitude at which the angular rate changes may indicate that torsional resonance is occurring. In any event, torsional vibration (and especially torsional resonance) that occurs during drilling operations can damage the drillstring and other components by creating fatigue and rapid failure of downhole components.

Linear vibrations encompass any motion of the drilling assembly in the axial or radial direction in relation to the drilling assembly's centerline. Typical examples of linear vibrations are whirl (forward and backward), lateral vibration, and axial vibration.

To detect and measure detrimental vibration, a drilling assembly obtains downhole motion measurements of the assembly using at least two accelerometer pairs so that the instantaneous motion (e.g., linear and angular displacement, velocity, and acceleration) can be derived at the drilling assembly, which offers several advantages. The drilling assembly can make these downhole measurements and can send real-time transmission of the drillstring's motion (e.g., one or more of linear and angular displacement, velocity, acceleration) to processing equipment for vibrational analysis. The drilling assembly can also make downhole measurements and real-time transmission of the drillstring's vibrational conditions, which operators can use in controlling drilling operations.

The at least two accelerometer pairs are oriented at a different orientation relative to one another on the drilling assembly. They may be translated tangentially about the drillstring by an angle of preferably 90 degrees. Each of the at least two accelerometer pairs contains at least two accelerometers oriented in another different orientation, and preferably in an orthogonal arrangement to each other and preferably parallel to an accelerometer in an opposing pair.

While drilling downhole, the angular and linear motion of the drilling assembly is determined with the measured acceleration from the at least two accelerometer pairs. The combination of output from the accelerometers of the pairs attempts to remove the effects of radial and tangential acceleration experienced by the accelerometers when sensing the motion of the drilling assembly so the combination of their acceleration data can determine linear and angular motion.

By analyzing the determined angular and linear motion, a determination that detrimental vibration is occurring during drilling can be made based on the analysis. Finally, the drilling assembly can automatically actuate downhole mechanisms to disrupt the detrimental vibration without operator intervention. For example, a downhole controller can use measurements by the angular rate gyroscope sensor and can provide feedback to actuate a torque clutch or other mechanism automatically. When actuated, the mechanism can interrupt the drilling for a period of time before re-engaging so detrimental vibration can be disrupted and the conditions causing it can be stopped or mitigated.

Having a drilling system able to measure and transmit this vibration information enables operators to mitigate detrimental effects on the drillstring. To do this, the drilling system directly measures data indicative of torsional, lateral, or axial vibration of the drillstring with the angular and linear motion sensor components. Once measured, this information may be processed and transmitted to the surface and notifies operators of the conditions downhole. In turn, indications of detrimental vibrations allow operations to take corrective actions and to avoid the damaging effects of torsional, lateral, or axial vibration on the drillstring.

In practice, a complete instantaneous diagnosis of downhole torsional, lateral, axial vibration, and other phenomena may be achieved by analyzing data from a combination of accelerometers, magnetometers, and other types of sensors.

To analyze the determined motion in one procedure, a pattern of vibration can be determined per one or more revolutions of the drilling assembly from the determined motion. To then determine that detrimental vibration is occurring during drilling, a severity measure of the detrimental vibration can be determined based on one or more aspects of the determined pattern. To analyze the determined motion in another procedure, one or more cycles of an increase in the determined motion can be determined per one or more revolutions of the drilling assembly. Then, a vibration measure, indicative of the detrimental vibration, can be calculated based on a number of the one or more cycles or based on an amplitude of the one or more cycles.

To analyze the determined motion in yet another procedure, vibration over revolutions over time of the drilling assembly can be determined. Then, a vibration measure, indicative of the detrimental vibration, can be calculated based on a frequency of the vibration over the revolutions over time of the drilling assembly. To analyze the determined motion and determine detrimental vibration in another procedure, a measure relating the maximum angular velocity over time, the minimum angular velocity over time, and the average angular velocity over time can be calculated.

The foregoing summary is not intended to summarize each potential embodiment or every aspect of the present disclosure.

DETAILED DESCRIPTION

A. Drilling Assembly

Figure 1:
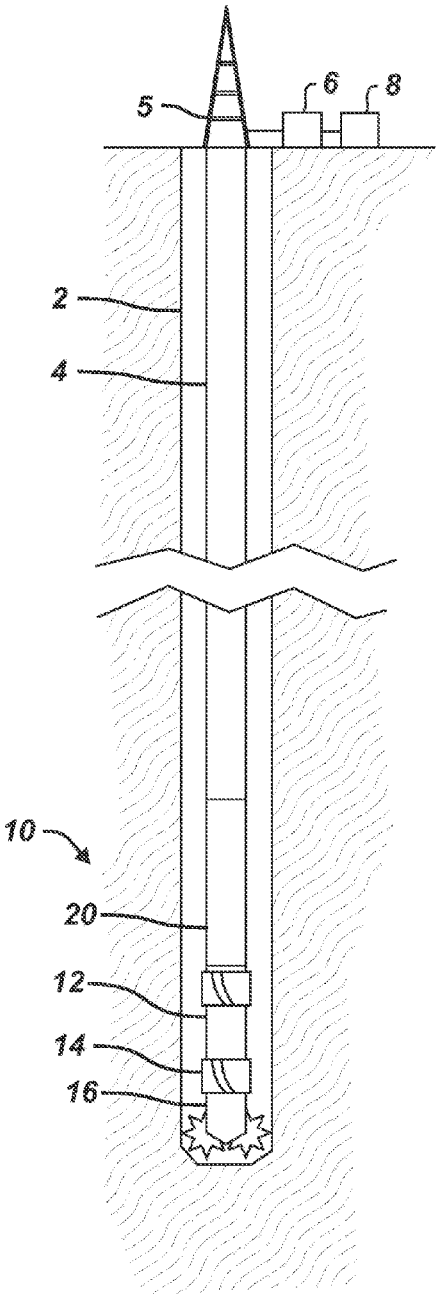
FIG. 1 illustrates a drilling system according to the present disclosure.

FIG. 1 shows a bottomhole assembly (BHA) or drilling assembly 10 suspended in a borehole 2 penetrating an earth formation. The drilling assembly 10 connects to a drillstring 4, which in turn connects to a rotary drilling rig uphole (represented conceptually at 5). The drilling assembly 10 includes a drill bit 16, which may be a polycrystalline diamond compact (PDC) bit, a rotary drilling bit rotated by a motor and a shaft, or any other suitable type of drill bit. In addition to the drill bit 16, the BHA 10 can have a drill collar 12, one or more stabilizers 14, and other conventional components (i.e., motor, rotary steerable system, etc.).

During drilling operations, the rotary rig 5 imparts rotation to the drill bit 16 by rotating the drillstring 4 and the drilling assembly 10. Surface equipment 6 typically controls the drillstring's rotational speed. In addition, a drilling fluid system 8 circulates drilling fluid or "mud" from the surface downhole through the drillstring 4. The mud exits through the drill bit 16 and then returns cuttings to the surface via the annulus. If the drilling assembly 10 has a motor (not shown), such as a "mud" motor, then motor rotation imparts rotation to the drill bit 16 through a shaft. The motor may have a bent sub, which can be used to direct the trajectory of the advancing borehole 2.

Figure 2A:
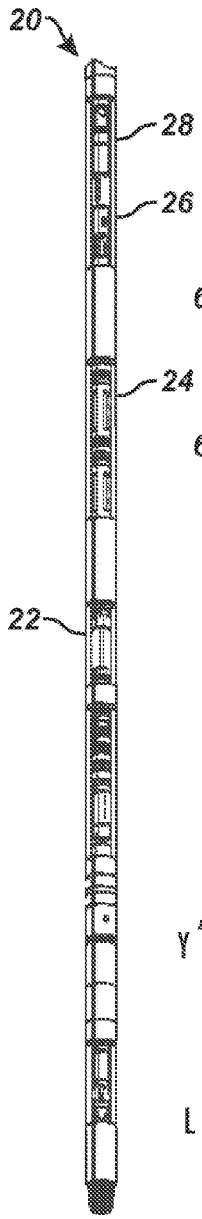
FIGS. 2A-2B illustrate a monitoring tool of the drilling system in more detail.
Figure 2B:
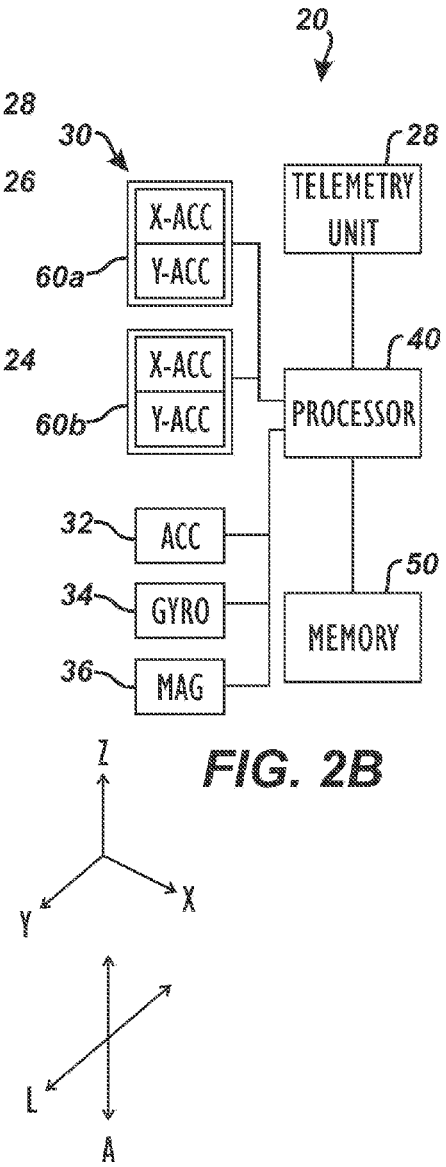

FIG. 2A shows a portion of the drilling assembly 10 in more detail. As shown, the drilling assembly 10 has a monitoring tool 20, components of which are schematically shown in FIG. 2B. Briefly, the tool 20 has a sensor section 22, a power section 24, an electronics section 26, and a telemetry section 28. The sensor section 22 has a sensor element 30, which includes at least two sensor pairs 60*a-b*, accelerometers 32, angular rate sensors 34, magnetometers 36, and other possible sensors (not shown).

The electronics section 26 houses electronic circuitry to operate and control the other elements within the drilling assembly 10. In particular, the electronics section 26 can include memory 50 for storing measurements made by the sensor section 22 and can include one or more processors 40 to process various measurement and telemetry data.

Finally, the telemetry section 28 communicates data with the surface by receiving and transmitting data to an uphole telemetry section (not shown) in the surface equipment 6. Various types of borehole telemetry systems are applicable, including mud pulse systems, mud siren systems, electromagnetic systems, and acoustic systems. The power section 24 supplies electrical power needed to operate the other elements within the drilling assembly 10.

During drilling, the monitoring tool 20 monitors the motion and revolutions-per-minute (RPM) of the drilling assembly 10 (collar 12, stabilizer 14, drill bit 16, etc.) on the drillstring 4. To monitor the assembly's motion, the tool 20 uses the sensor element 30 (which as noted above includes the sensor pairs 60*a-b* and can include other accelerometers 32, angular rate sensors or gyroscopes 34, and magnetometers 36). Using measured data from these sensors, the monitoring tool 20 provides information about torsional, lateral, and axial vibration occurring while drilling, which can help operators control and improve the drilling process.

Turning to more details of the sensor element 30, the sensor pairs 60*a-b* each include a pair of arranged acceleration sensors (e.g., accelerometers) for measuring acceleration data of the assembly's motion during drilling. Analysis of the measured acceleration data is then used to determine the motion of the drilling assembly 10 during drilling. The determined motion can include angular and/or linear motion of the drill string during drilling. Additionally, such motion may encompass one or more of displacement, velocity, and acceleration. In turn, the details of the determined angular and linear motion can be used to analyze and characterize the vibration encountered by the drilling assembly 10 during drilling.

The at least two accelerometer pairs 60*a-b* are arranged on the sensor element 30 as discussed below. In general, though, the at least two accelerometers in each pair 60*a-b* are preferably arranged orthogonal to one another, and the two pairs 60*a-b* are preferably arranged orthogonal to each other on sensor element 30. Any suitable type of acceleration sensor or accelerometer can be used in the pairs 60*a-b* for measuring acceleration data in a downhole environment.

As for the other sensors in monitoring tool 20, one or more accelerometers 32, angular rate sensors 34, and magnetometers 36 can measure additional aspects of the orientation and motion of the drilling assembly 10 within the borehole 2. In addition to these, the sensor section 22 can also have other sensors used in Measurement-While-Drilling (MWD) and Logging-While-Drilling (LWD) operations including, but not limited to, sensors responsive to gamma radiation, neutron radiation, and electromagnetic fields.

As is known, the magnetometers 36 can be a fluxgate device whose output indicates its orientation with respect to the earth's magnetic field. Accordingly, the magnetometers 36 can be used to calculate the azimuth and magnetic toolface of the tool 20 as it rotates. "Azimuth" refers to an angle in a horizontal plane measured relative to magnetic north. Magnetic toolface is typically measured clockwise from the reference magnetic north bearing, beginning at 0° and continuing through 360°.

The tool 20 can also have the additional accelerometers 32 arranged relative to one another and directly coupled to the insert in the tool 20. These accelerometers 32 may also be intended to measure acceleration forces acting on the tool 20. Likewise, the accelerometers 32 can measure inclination and toolface with respect to gravity of the tool 20, and they can detect at least some of the vibration and shock experienced by the drillstring 4 downhole. The downhole angular and linear motion obtained by the sensor element 30 combined with the accelerometer and magnetometer data from the monitoring tool 20 helps identify the dynamics downhole. Knowing the type(s) of vibration allows operators to determine what parameters to change to alleviate the experienced vibration.

For the angular rate sensors 34 in the tool 20, at least one angular rate sensor 34 can be disposed on the tool's roll axis (i.e., a "roll gyroscope" is set to sense rotation of the drilling assembly 10 around the assembly's longitudinal or Z-axis). The angular rate sensor 34 can measure the angular rate or velocity of the tool 20 as it rotates downhole during drilling. Further details of a preferred angular rate sensor 34 and use of its measured data are discussed in incorporated U.S. Pat. Pub. 2013/0092439.

If desirable, the tool 20 can have one or more other angular rate sensors 34 arranged on other axes of the tool 20. These other angular rate sensors 34 can be mounted perpendicular to one another and can measure pitch and yaw of the tool 20 during drilling by measuring the angular rate or velocity in the X and Y-axes.

In general, the tool 20 does not need to determine a geometric reference of the borehole (e.g., magnetic north or a high-side of a horizontal borehole) during drilling in some implementations. Yet, a geometric reference, such as magnetic north, highside of a horizontal borehole, and the like can be determined by the processor 40 using the accelerometers 32, the magnetometers 34, or other sensors based on techniques known in the art. The determined geometric reference can then be applied periodically to the measurements of the at least two accelerometer pairs 60*a-b* so the measurements are synced to the geometric reference, which can be beneficial in some implementations.

Along the same lines as synchronizing the measurements of the at least two accelerometer pairs 60*a-b* to a geometric reference, it may be desirable to re-bias the at least two accelerometer pairs 60*a-b* periodically during operation. Being electronic devices outputting voltage, the at least two accelerometer pairs 60*a-b* have a bias due to inherent factors, temperature, and the like. The processor 40 accounts for this bias when processing the measurements obtained by the at least two accelerometer pairs 60*a-b*. Periodically, when rotation of the tool 20 is stopped, the processor 40 can determine the bias of the sensors in the pairs 60*a-b* so a corrected bias can be taken out of the subsequent measurements of the at least two accelerometer pairs 60*a-b*. These procedures can prevent a "walk" of the measurements as the at least two accelerometer pairs 60*a-b* function overtime.

The tool 20 is programmable at the well site so that it can be set with real-time triggers that indicate when the tool 20 is to begin logging or transmitting vibration data to the surface. In general, the tool's processor 40 can process raw data downhole and can transmit processed data to the surface using the telemetry system 28. Alternatively, the tool 20 can transmit raw data to the surface where processing can be accomplished using surface processing equipment 6 (FIG. 1). The tool 20 can also record data in memory 50 for later analysis. Finally, the processor 40, at least two accelerometer pairs 60*a-b*, accelerometers 32, angular rate sensors 34, magnetometers 36, memory 50, and telemetry unit 28 can be those suitable for a downhole tool, such as used in Weatherford's HEL system.

During drilling, various forms of vibration may occur to the drillstring 4 and the drilling assembly 10 (i.e., drill collar 12, stabilizers 14, and drill bit 16 as well as bent sub, motor, rotary steerable system (not shown), etc.). In general, the vibration may be caused by properties of the formation being drilled, by the drilling parameters being applied to the drillstring 4, the characteristics of the drilling components, and other variables. Regardless of the cause, the vibration can damage the drilling assembly 10, reducing its effectiveness and requiring one or more of its components to be eventually replaced or repaired.

Several real-time data items and calculations can be used for analyzing the vibration experienced by the drillstring 4 and assembly 10 during drilling, and the real-time data items and calculations can be provided by the monitoring tool 20 of FIGS. 1 and 2A-2B. In one implementation, real-time data items can cover acceleration, RPM, peak values, averages, angular velocity, etc. As detailed herein, tracking these real-time data items along with vibration calculations helps operators to monitor drilling efficiency and determine when the drilling parameters need to be changed. To deal with damage and wear on the drilling assembly 10, the techniques of the present disclosure can identify and quantify levels of torsional, lateral, and axial vibration, which in turn can indicate wear or damage to the assembly 10.

To identify and quantify levels of torsional, lateral, axial vibration, and other vibrations, the tool 20 can use its sensor element 30 to measure the angular and linear motion, etc. of the assembly 10 during drilling and can associate the measurements with particular toolfaces or radial orientations of the assembly.

The processor 40 then records the measured data in memory 50 at particular toolfaces and processes the measured data using calculations as detailed below to determine the type and extent of vibration. In turn, the processor 40 can transmit the data itself, some subset of data, or any generated alarm to the surface. In addition to or in an alternative to processing at the tool 20, the raw data from the sensor element 30 can be transmitted to the surface where the calculations can be performed by the surface processing equipment 6 for analysis.

The tool 20 can store the measured data within downhole memory 50. Also, some or all of the information, depending on the available bandwidth and the type of telemetry, can be telemetered to the surface for additional processing. In any event, the processor 40 at the tool 20 can monitor the data to detect detrimental vibrations caused by torsional, lateral, axial vibration, and the like. This can trigger an alarm condition, which can be transmitted uphole instead of the data itself. Based on the alarm condition, operators can adjust appropriate drilling parameters to remove the detrimental vibration.

If stick-slip is detected, for example, drilling operators may be able to reduce or eliminate stick-slip vibrations by adjusting rotary speed and/or weight on bit (WOB). Alternatively, the drilling operators can use a controller on the rotary drive that varies the energy provided by the rotary drive and interrupts the oscillations that develop.

Whirl, however, may be self-perpetuating. Therefore, in some instances, drilling operators may only be able to eliminate whirl vibration by stopping rotation altogether (i.e., reducing the rotary speed to zero) as opposed to simply adjusting the rotary speed and/or weight on bit. Of course, drilling operators can apply these and other techniques to manage the drilling operation and reduce or eliminate detrimental vibrations.

Further details of some procedures of identifying and quantifying levels of stick-slip and/or whirl vibrations are provided in U.S. Pat. Pub. 2011/0147083, which is incorporated herein by reference in its entirety.

With an understanding of the monitoring tool 20, discussion now turns to the details of the accelerometers pairs 60*a-b* and how their measurements can be used to derive the motion (e.g., one or more of the angular and linear displacement, velocity, and acceleration) and other aspects of the downhole assembly's motion and vibration.

1. One Arrangement of Accelerometer Pairs

Figure 3A:
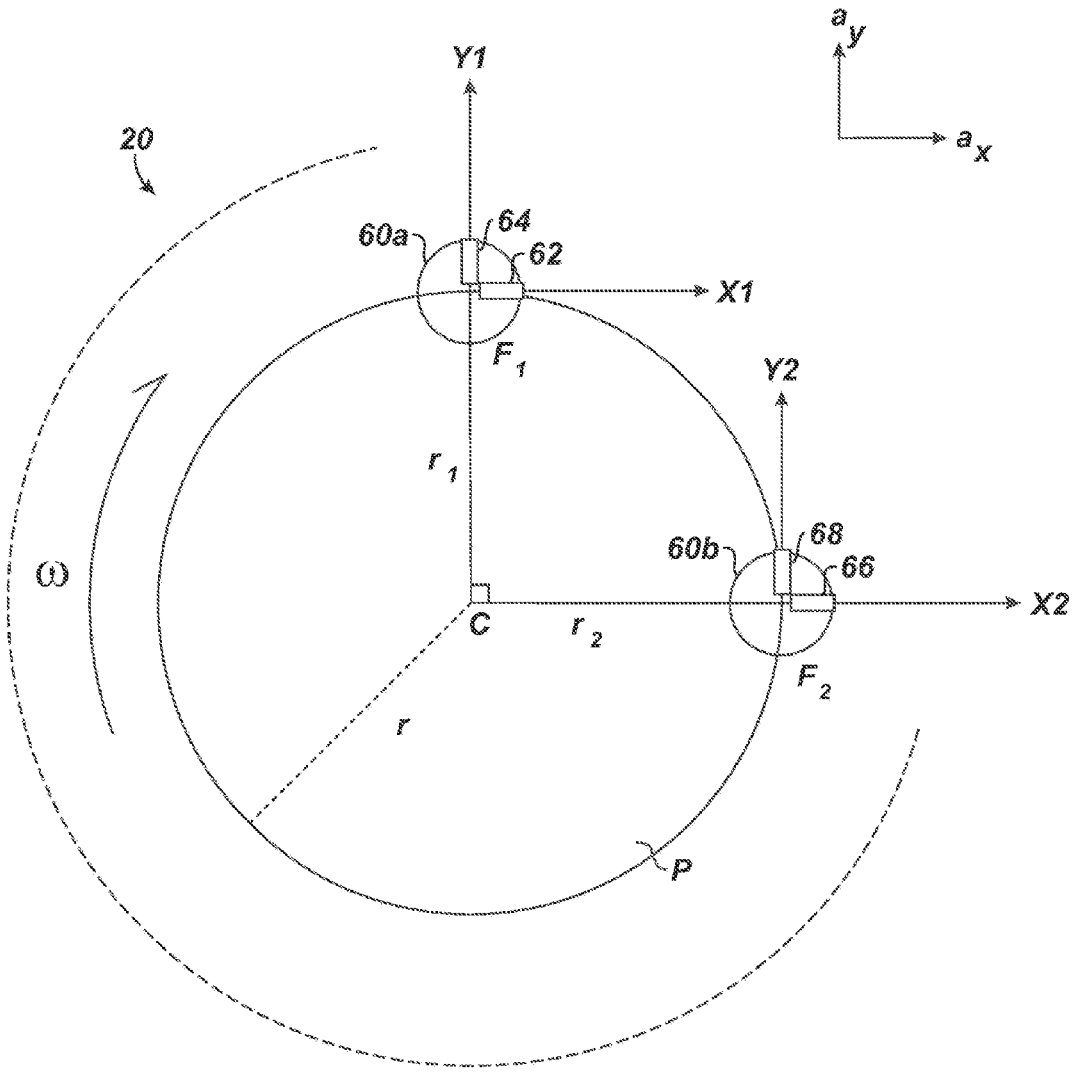
FIG. 3A schematically illustrates sensor pairs for the disclosed sensor element.

As shown in FIG. 3A, the at least two accelerometer pairs 60*a-b* include two sets or pairs of accelerometers 62, 64 and 66, 68. The pairs 60*a-b* are set off-axis from a central longitudinal axis C of the tool 20 about which the tool 20 rotates. As will be appreciated from previous discussions, the tool 20 would include part of the drilling assembly 10 (e.g., drill collar or the like), which would typically have a flow bore therethrough. As will be appreciated, the accelerometers 62, 64 and 66, 68 can be mounted directly in the collar, can be housed in an insert mounted in the collar, or can be mounted using any other known technique.

As diagrammatically shown in FIG. 3A, the accelerometer pairs 60*a-b* are generally disposed at a different orientation relative to one another on the tool 20, and the accelerometers 62/64 and 66/68 in each pair 60*a-b* are disposed at a different orientation relative to one another. Additionally, the first and second pairs 60*a-b* are preferably disposed on the same lateral plane P across the tool's center axis (C).

In the preferred arrangement shown, the first and second pairs 60*a-b* are disposed at the same radius (e.g., $r_1=r_2$) from the tool's central axis (C), but this is not strictly necessary. Additionally, the pairs 60*a-b* are disposed at 90-degrees from one another about the tool's central axis (C). Finally, the accelerometers 62, 64 and 66, 68 of each pair 60*a-b* are mounted on the sensor element 30 such that the pairs 60*a-b* provide both tangential and radial X-Y components of the tool's acceleration.

In particular, the first accelerometer 62 of the first pair 60*a* is situated in the X-direction and is preferably situated tangential to the direction of the tool's rotation to provide an X1-component of the tool's motion. Polarity of the first accelerometer's readings may be in the direction of rotation. The second accelerometer 64 of the first pair 60*a* is preferably situated orthogonal to the first accelerometer 62, radial to the central axis (C) of the tool 20, in the Y-direction to provide a Y1-component of the tool's motion.

As further shown, the second accelerometer pair 60*b* disposed on the sensor element 30 includes the third and fourth accelerometers 66 and 68, which are somewhat comparably arranged. The third accelerometer 66 is situated in the X-direction, radial to the central axis (C) of the tool 20, to provide an X2-component of the tool's motion, which is preferably parallel to the first accelerometer's X1-component. The fourth accelerometer 68 is preferably situated orthogonally in the Y-direction to provide a Y2-component of the tool's motion so that this Y2-component is tangential to the tool's rotation. Polarity of the fourth accelerometer's readings may be counter to the tool's rotational direction. Thus, the Y2-component is preferably parallel to the Y1-direction of the second accelerometer 64.

As noted above, the accelerometer pairs 60*a-b* in the preferred arrangement are arranged on the same lateral plane P, the accelerometers 62/64 and 66/68 in each pair 60*a-b* are preferably arranged orthogonal to one another, and the two pairs 60*a-b* are preferably arranged orthogonal to each other. Additionally, each pair 60*a-b* is preferably arranged at the same radius (e.g., $r_1=r_2$) relative to the central axis C of the tool 20, and each accelerometer 62/64 and 66/68 within each pair 60*a-b* are arranged at the same radius relative to the central axis C as the other accelerometer of the pair.

Although such an arrangement is preferred, it is not strictly necessary. As will be appreciated, arranging the accelerometers 62, 64, 66, 68 and the pairs 60*a-b* on the same plane, orthogonal to one another, and at the same radius can only be approximately achieved in a real implementation, but calibration and other techniques can be used to account for any offsets, misalignments, and the like. As will also be appreciated, the arrangement of the accelerometers 62, 64, 66, 68 and pairs 60*a-b* need not be intentionally orthogonal, uniform, symmetrical, etc. Instead, known angular orientations other than orthogonal can be used, and the acceleration readings can be mathematically solved for orthogonality using laws of trigonometry to derive the orthogonal components of interest in the present teachings. Thus, reference to orthogonal arrangements used herein is exemplary because other geometric arrangements can be used and accounted for without departing from the teachings of the present disclosure. In the end, it is the various components of the acceleration in the X and Y directions that are of interest.

Additionally, the two pairs 60*a-b* need not be arranged at the same radius, and the accelerometers 62/64 or 66/68 of each pair 60*a-b* need not both be at the same radius. Instead, the pairs 60*a-b* can be set at different known radii ($r_1$ and $r_2$), and the acceleration components associated with the pairs 60*a-b* can be calculated. The same applies for any difference in radii for the accelerometers 62/64 or 66/68 of a given pair 60*a-b*. As will be appreciated, a greater radius is preferred so that the sensor readings are well above any noise. In fact, the sensitivity of the particular accelerometers 62, 64 and 66, 68 used can be optimized for a particular radial arrangement.

The readings from the accelerometers 62, 64 and 66, 68 are preferably sampled simultaneously to facilitate data handling and comparison. Numerical methods, statistical analysis, and other processing techniques can be used to account for any differences in sampling rates and times of the accelerometers' readings. Sampling rates on the order of 1000 samples per second may be used for instantaneous understanding of the tool's motion because certain vibrations downhole may have complex or varying frequency characteristics. Finally, any difference in the polarities of the accelerometers 62, 64, 66, 68 can be routinely accounted for mathematically.

As noted herein, the at least two accelerometer pairs 60*a-b* provide measurements for determining the angular and linear motion. The combination of output from these accelerometers 62, 64, 66, and 68 attempts to remove the effects of radial and tangential acceleration experienced by the accelerometers 62, 64, 66, and 68 when sensing the motion of the drilling assembly 10.

The measurements taken by the accelerometers 62, 64, 66, and 68 of the at least two accelerometer pairs 60*a-b* illustrated in FIG. 3A can be expressed by the following equations:

$$a_{x1}=a_x+r_1\alpha$$

$$a_{x2}=a_x+r_2\omega^2$$

$$a_{y1}=a_y+r_1\omega^2$$

$$a_{y2}=a_y-r_2\alpha \qquad \text{(Eq. 1)}$$

As will be appreciated, the equations presented herein assume ideal accelerometers: actual processing can account for characteristics of true accelerometers. Additionally, the equations presented herein are configured for the preferred arrangement of the at least two accelerometer pairs 60*a-b* (i.e., on the same plane, each sensor orthogonal in a give pair 60*a-b*, and each pair 60*a-b* orthogonal on the tool 20, etc.). If a different arrangement is used, the various orthogonal components can be geometrically derived.

The second terms in the above-equations represent the bias created by radial and tangential acceleration and the angular velocity of the accelerometers 62, 64, 66, and 68. Due to the arrangement of the accelerometers 62, 64, 66, and 68, the radial and tangential acceleration bias can be removed. In particular, the acceleration measured by the tangentially mounted accelerometers 62 and 68 includes the overall X and Y component, respectively, of acceleration experienced from the center frame (C) of the drillstring as well as the tangential acceleration component ($r\alpha$) due to the sensors' 62 and 68 locations in the off-center frames $F_1$, $F_2$. In contrast, the acceleration measured by the radially mounted accelerometers 66 and 64 includes the overall X and Y component, respectively, of acceleration experienced from the center frame (C) of the drillstring as well as the radial acceleration component (rω2) due to the sensors' 66 and 64 locations in the off-center (non-inertial) frames $F_1$, $F_2$.

From the above equations, true linear X and Y accelerations can be derived for the tool 20 when corrected for the offset caused by the rotational components.

$$a_x = \frac{a_{x1}r_2^2 + (a_{y2} - a_{y1})r_1r_2 + a_{x2}r_1^2}{r_1^2 + r_2^2} \quad \text{(Eq. 2)}$$

$$a_y = \frac{a_{y1}r_2^2 + (a_{x1} - a_{x2})r_1r_2 + a_{y2}r_1^2}{r_1^2 + r_2^2}$$

The resultant lateral vector calculation can be defined as follows:

$$a_{lat} = \sqrt{a_x^2 + a_y^2} \quad \text{(Eq. 3)}$$

Finally, the equations below represent the angular components (i.e., angular acceleration α and angular velocity ω) derived from the linear accelerations measured by the at least two accelerometer pairs 60*a-b* of the tool 20:

$$\alpha = \frac{(a_{x1} - a_{x2})r_1 + (a_{y1} - a_{y2})r_2}{r_1^2 + r_2^2} \quad \text{(Eq. 4)}$$

$$\omega = \sqrt{\frac{a_{x2}r_2 - a_{x1}r_2 - a_{y2}r_1 + a_{y1}r1}{r_1^2 + r_2^2}} \quad \text{(Eq. 5)}$$

If $r_1=r_2=r$, then the equations for acceleration measurements can be simplified as follows:

$$a_{x1} = a_x + r_1\alpha$$

$$a_{x2} = a_x + r\omega^2$$

$$a_{y1} = a_y + r\omega^2$$

$$a_{y2} = a_y - r\alpha \quad \text{(Eq. 1')}$$

When $r_1=r_2=r$, then the equations for the true linear X and Y accelerations can be simplified to:

$$a_x = \frac{a_{x1} - a_{y1} + a_{x2} + a_{y2}}{2} \quad \text{(Eq. 2')}$$

$$a_y = \frac{a_{x1} + a_{y1} - a_{x2} + a_{y2}}{2}$$

When $r_1=r_2=r$, then the equations for angular acceleration α and angular velocity ω can be simplified to:

$$\alpha = \frac{a_{x1} + a_{y1} - a_{x2} - a_{y2}}{2r} \quad \text{(Eqs. 4' \& 5')}$$

$$\omega = \sqrt{\frac{-a_{x1} + a_{y1} + a_{x2} - a_{y2}}{2r}}$$

Thus, as the tool 20 rotates and the accelerometers 62, 64, 66, and 68 each measure acceleration data, the tool's processor 40 (either alone or in conjunction with a surface processor) can determine the angular acceleration α, angular velocity ω, and true lateral acceleration of the tool 20 in real-time (or near real-time). The calculations may not be able to determine clockwise or counterclockwise rotation. Instead, this aspect of the motion can be determined using other techniques and other sensors of the tool 20. Finally, calculation for the linear and angular position of the tool 20 may be ascertained through numerical integration techniques, which can be used to analyze the motion of the assembly 10 relative to the known borehole size being drilled. In the end, being able to determine the angular components and the positions of the tool 20 downhole, the motion of the tool 20 can be analyzed for features, characteristics, and the like indicative of detrimental vibration, such as stick-slip, bit whirl, torsional vibration, etc.

One advantage afforded by the at least two accelerometer pairs 60*a-b* is that true linear and angular motion of the drilling assembly 20 can be determined. This unique sensor configuration allows for correction of any bias resulting from the rotation and vibration of the sensor element 30. As is known, the drilling environment creates a great deal of shock and vibration that compromises measurements obtained from conventional downhole sensor configurations. The particular arrangement of sensing elements from the at least two accelerometer pairs 60*a-b*, however, removes the effects of both radial and tangential acceleration so true angular and linear motion of the assembly 10 can be determined. Being able to measure true angular and linear motion of the drilling assembly 10 with the disclosed pairs 60*a-b* without interference from shock and vibration is, therefore, particularly useful in determining vibration in the drilling assembly 10.

2. Another Arrangement of Accelerometer Pairs

Figure 3B:
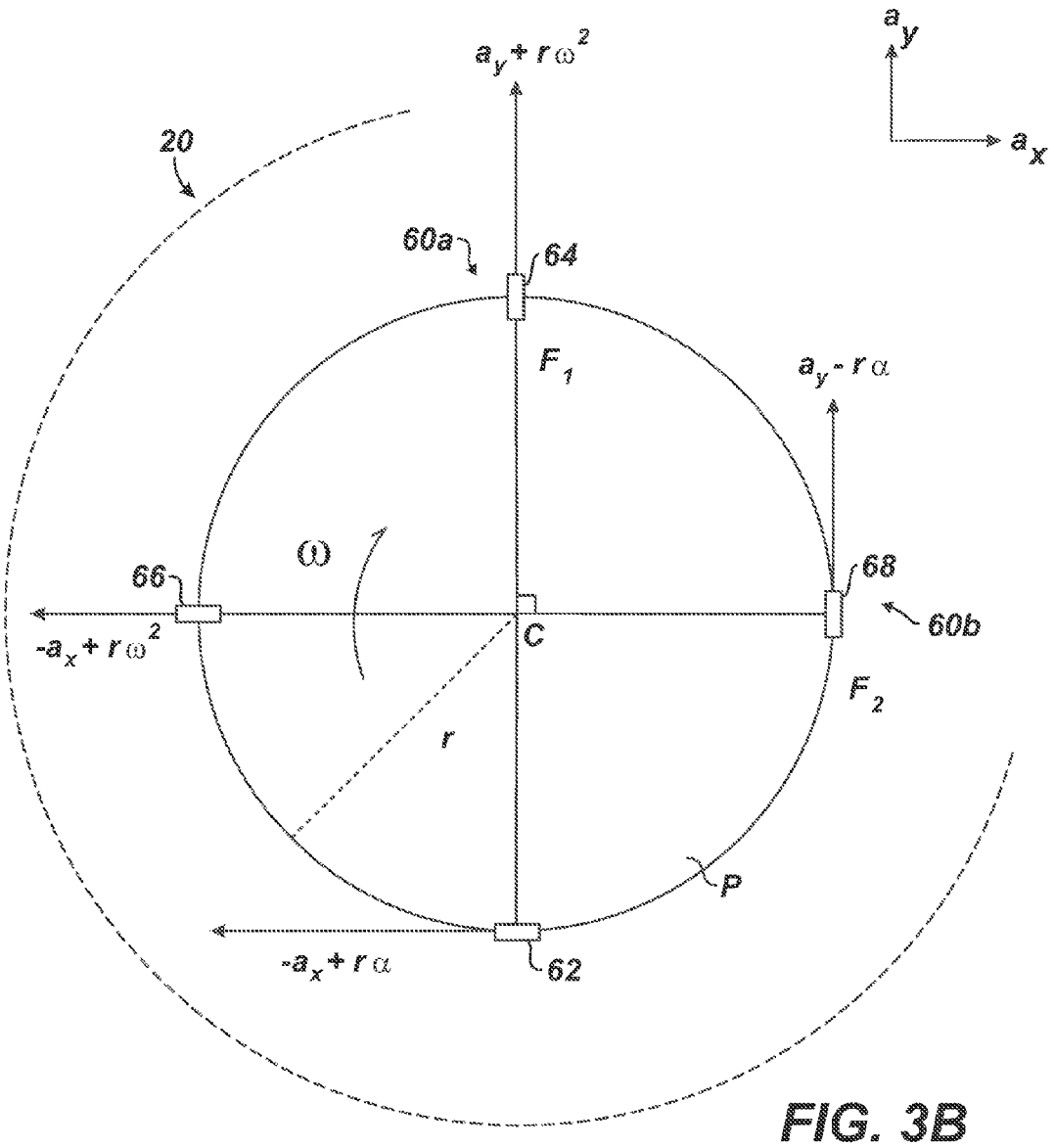
FIG. 3B schematically illustrates another arrangement of sensor pairs for the disclosed sensor element.

FIG. 3B shows an alternative mounting scheme for the at least two accelerometer pairs 60*a-b*, which include two sets or pairs of accelerometers 62, 64 and 66, 68. As before, the pairs 60*a-b* are set off-axis from a central longitudinal axis C of the tool 20 about which the tool 20 rotates. In this arrangement, the pairs 60*a-b* are "split." The pairs include the first pair 60*a* having accelerometers 62, 64 on opposing sides of one another and include the second pair 60*b* having accelerometers 66, 68 on opposing sides of one another and offset 90-degrees to the first pair 60*a*. As can be seen for this and any other configuration, the arrangement of accelerometers 62, 64, 66, and 68 preferably includes radial and tangential accelerometers in both the X and Y directions.

Here, accelerometer 62 is tangential in the X-direction, and accelerometer 66 is radial in the X-direction. Also, accelerometer 64 is radial in the Y-direction, and accelerometer 68 is tangential in the Y-direction. Thus, the first pair 60*a* includes tangential X-direction accelerometer 62 and radial Y-direction accelerometer 64. The second pair 60*b* includes radial X-direction accelerometer 66 and tangential Y-direction accelerometer 68.

Equations for the measured acceleration are depicted beside each one of the accelerometers 62, 64, 66, and 68. In comparison to the previous arrangement of FIG. 3A, the current arrangement of FIG. 3B has slight differences in sign. For accelerometers 62 and 66, the first term (ax) is now negative. This is due to the polarity orientation of the X-direction accelerometers 62 and 66, but the polarity orientation could just as easily point in an opposite direction. As can be seen, the second term in both equations would have a sign change. Likewise, the polarity of the Y-direction accelerometers 64 and 68 could be reversed producing a change of sign of both terms.

As before, the arrangement of FIG. 3A uses the same radius (r) for all of the accelerometers 62, 64, 66, and 68, but each accelerometer 62, 64, 66, and 68 could have an independent radius. Finally, comparable equations for this arrangement in FIG. 3B can be configured similar to the equations for the arrangement in FIG. 3A so that the discussion is not repeated here.

B. Vibration Analysis Techniques

Figure 4:
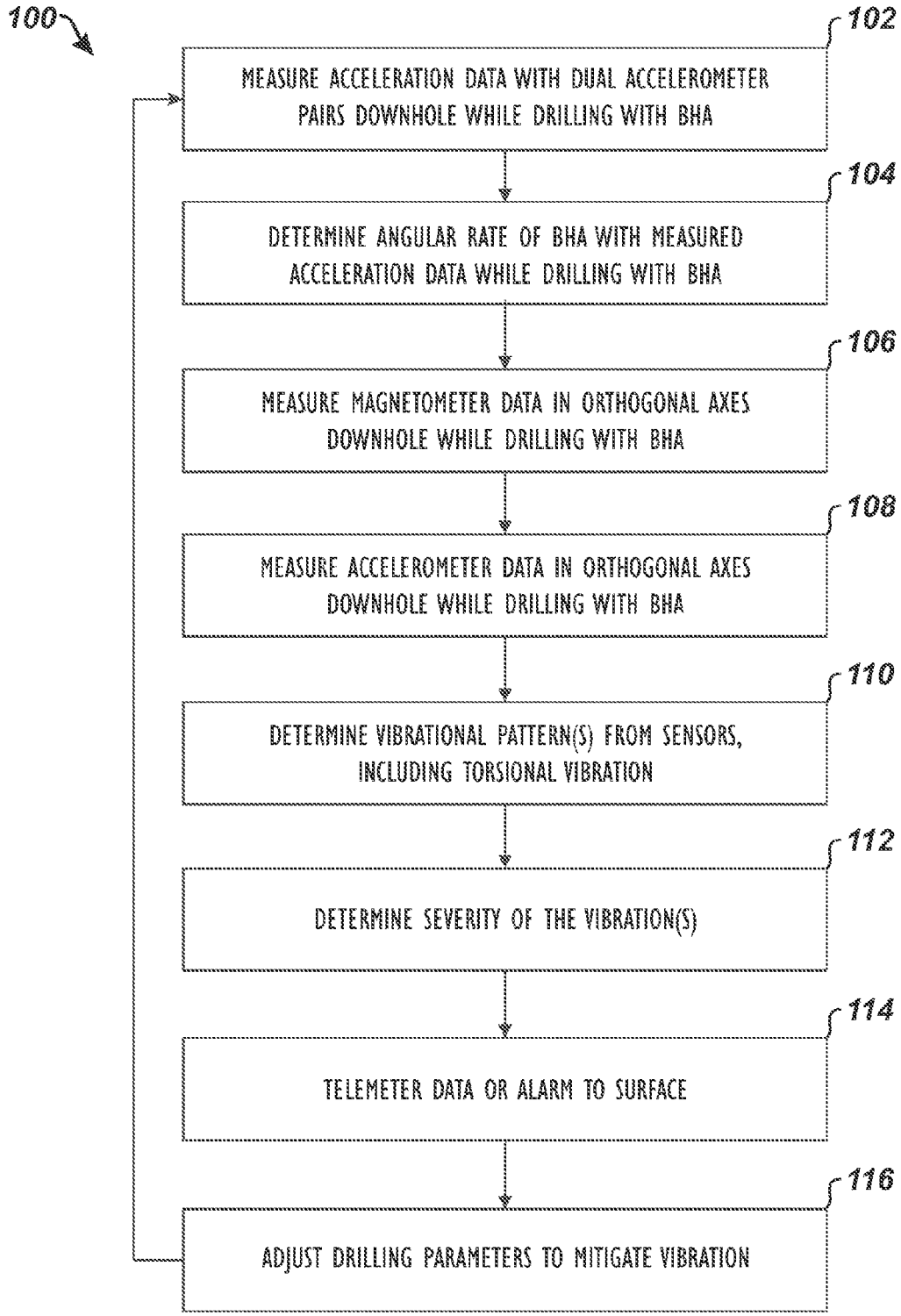
FIG. 4 is a flowchart showing a technique for determining whether detrimental vibrations are occurring downhole.

With an understanding of the monitoring tool 20 and sensors, such as the at least two accelerometer pairs 60*a-b*, discussion now turns to FIG. 4, showing an analysis technique 100 according to the present disclosure in which detrimental vibration of the drillstring 4 is determined. The technique 100 can use the tool 20 of FIGS. 2A-2B having the sensor element 30, processor 40, memory 50, and telemetry unit 28 and can use the arrangement of the at least two accelerometer pairs 60*a-b* as in FIGS. 3A-3B or other arrangement. For the benefit of discussion, reference will be made in particular to the arrangement in FIG. 3A.

Initially, the tool 20 measures acceleration data with the accelerometers 62, 64 and 66, 68 of the acceleration pairs 60*a-b* (Block 102). Using the calculations as noted herein, the tool 20 then determines the angular and linear motion of the drilling assembly 10 over time (Block 104). Additionally, the tool 20 can measure angular rate with an angular rate sensor 34 as part of Block 104, if the tool 20 has such a sensor 34.

Additional data can also be obtained. For example, the tool 20 can measure magnetometer data with the magnetometers 36 (Block 106) and can measure accelerometer data with other accelerometers 32 (Block 108) in orthogonal axes downhole while drilling. At least some of these additional accelerometers 32 can be disposed at the central axis C of the tool 20, if space allows for such a placement, rather than being off-set.

This additional data can be used for various purposes. For example, the 360-degree rotational cycle of the drilling assembly 10 can be configured into bins or segments to facilitate the data analysis. During drilling, for example, the tool 20 can measure data from the x and y-axis magnetometers 36, and the processor 40 can apply the geometric reference angle to the sensor element 30 and derive a toolface velocity (RPM) of the drilling assembly 10. As the tool 20 rotates on the drilling assembly 10, data for a streaming toolface can come from any of a number of sources downhole. Preferably, the orthogonal magnetometers 36 are used because of their immunity to noise caused by vibration. However, other sensors could be used, including the angular rate sensors 34 and other accelerometers 32. The processor 40 can use the toolface binning to derive the toolface velocity (RPM) during drilling, which produces a less complicated and cumbersome model.

From the resulting toolface velocity (RPM) data, other measured data, and calculations, the processor 40 recognizes whether detrimental vibrations are occurring (Block 110). In particular, the processor 40 can determine if detrimental vibrations are occurring from torsional, lateral, and axial vibration and the like (Block 110). As discussed herein, this determination can distinctly use the angular rate derived from the acceleration pairs 60*a-b* of the drilling assembly 10.

In determining the angular and linear motion, the disclosed techniques may not be particularly interested in the actual high-side or magnetic toolface (geometric reference), although such a geometric reference can be helpful. In other words, binning the RPM of the tool 20 may not be of interest, although it may be useful for determining stick-slip, whirl, or other vibration as noted herein. In any event, the angular and linear motion data can be combined with geometric reference, accelerometer, and magnetometer data to provide more details about the downhole vibrations.

Once detrimental vibration is encountered, the processor 40 proceeds to determine the severity of the vibrations (Block 112). The level of severity can depend on the type of vibration, the level of the vibration, the time span in which the vibration occurs, or a combination of these considerations as well as others, such as any cumulative effect or extent of the drilled borehole in which the vibration occurs. Accordingly, the details of the detrimental vibrations are compared to one or more appropriate thresholds.

If the vibrations are sufficiently severe, then the processor 40 uses the telemetry unit 28 to telemeter raw data, processed data, alarm conditions, or each of these uphole to the surface equipment 6 (Block 114). For example, telemetry of an alarm or warning can be done when severe variations are occurring, which could indicate stick-slip, whirl, or torsional vibration. The tool 20 can pulse up details of the detrimental vibration, such as a severity measure or various levels of torsional vibration including low, moderate, and high.

Drilling operators receive the data, and the surface equipment 6 displays the information and can further process the information. Once the detrimental vibrations are known, corrective action can be taken. For example, drilling operators can manually adjust drilling parameters to counteract the vibration, or the surface equipment 6 can automatically adjust the parameters (Block 116). Various parameters could be adjusted to mitigate the vibration, including, but are not limited to, weight on bit, rotational speed, torque, pump rate, etc.

C. Torsional Vibration Details

Figure 5:
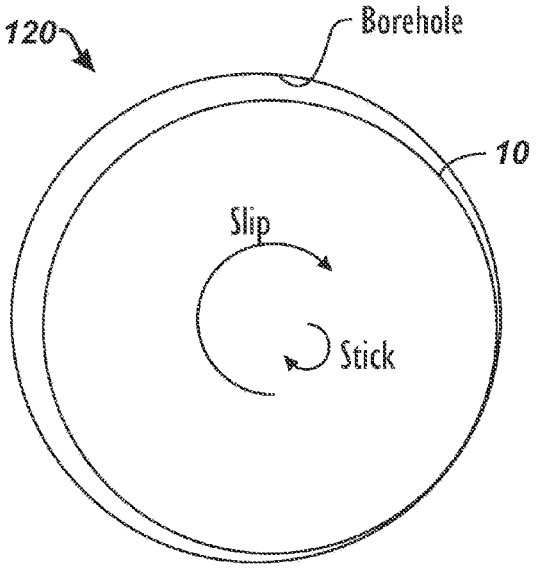
FIG. 5 conceptually shows motion of the drilling assembly in a borehole during stick-slip vibration.

Torsional vibration encompasses a number of drillstring dysfunctions that result in fluctuations in downhole angular velocity. Typical forms of torsional vibration include Stick-Slip and Torsional Resonance (low and high frequency). Briefly, stick-slip is a torsional or rotational type of vibration caused by the bit 16 interacting with the formation rock or by the drillstring 4 interacting with the borehole wall. FIG. 5 diagrammatically shows an end view of the drilling assembly 10 disposed in a borehole to illustrate stick-slip. As shown, stick-slip 120 usually involves torsional vibration of the drillstring 4 in which the drilling assembly 10 alternates between intervals of stopping and sticking to the borehole and intervals of slippage or increased angular velocity (RPMs) of the drilling assembly 10. During periods of stick-slip 120, the instantaneous bit speeds are much faster than the average rotational speed observed at the surface. In fact, the maximum instantaneous RPM at the bit 16 can be several times the average RPM at the surface.

In one way to determine if stick-slip is occurring, processing can use a stick-slip index, which is a dimensionless measurement indicative of stick-slip. Below is an equation for a stick-slip index as found in Macpherson, J., "The Science of Stick-Slip," IADC Stick-Slip Mitigation Workshop, Jul. 15, 2010:

$$SSI = \frac{\max(RPM) - \min(RPM)}{2 \cdot avg(RPM)}.$$

To calculate the index, the maximum rotation (RPM) is subtracted by the minimum rotation (RPM) and the result is divided by twice the average rotation (RPM). The resulting value is indicative of stick-slip. Various values between 0 and 1 can indicate various severity levels of stick-slip, and any value over "1" would indicate a severe stick-slip condition.

Torsional resonance occurs when one of the torsional resonant frequencies of the drilling assembly 10 or drillstring are excited. These are typically characterized by periodic (sinusoidal) oscillations in downhole angular velocity. The amplitude of such downhole oscillations can range from as little as 10-20% of the angular velocity at surface to more than double. The potential for large and rapid oscillations in downhole angular velocity can be extremely damaging to drilling systems and PDC drill bits especially when high frequency resonances are excited.

For details related to determining that torsional vibration is occurring in Block 110 of FIG. 4, the processor 40 can determine whether any vibration patterns are occurring. Particular techniques are discussed in incorporated U.S. Pat. Pub. 2011/0147083. In general, the processor 40 can derive the toolface velocity using binning and measurements from magnetometers. (Alternatively, the processor 40 can calculate the number of revolutions the drillstring 4 has made using an angular rate sensor 34 or the at least two accelerometer pairs 60*a-b* of the present disclosure because they can send out the angular rate over time.) This toolface velocity in turn can be used to determine the toolface of the drilling assembly 10, which may be useful in analyzing the downhole vibrations, such as stick-slip and whirl.

D. Linear Vibration Details

Linear vibrations encompass any motion of the drilling assembly 10 in the axial or radial direction in relation to the drilling assembly's centerline (C). Typical examples of linear vibrations are whirl (forward and backward), lateral vibration, and axial vibration.

To determine that whirl is occurring in Block 108 of FIG. 5, the processor 40 can determine whether certain vibration patterns are occurring using the derived toolface velocity. Particular techniques are discussed in incorporated U.S. Pat. Pub. 2011/0147083.

Figure 6:
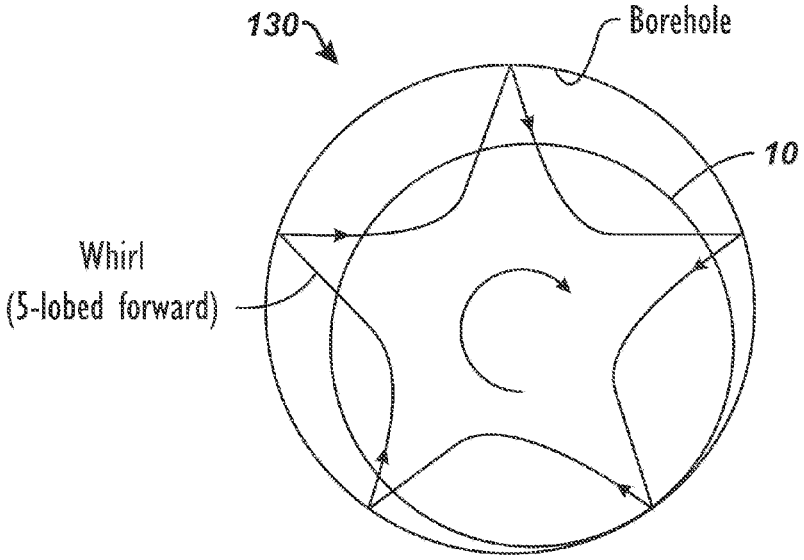
FIG. 6 conceptually shows motion of the drilling assembly in a borehole during whirl vibration.

In contrast to torsional vibration, whirl is a bending or lateral type of vibration. FIG. 6 diagrammatically shows an end view of the drilling assembly 10 disposed in a borehole to illustrate bit whirl. In forward whirl, the drilling assembly 10 deflects and precesses around the borehole axis in the same direction that the drilling assembly 10 rotates. In backward whirl, the drilling assembly 10 deflects and precesses around the borehole axis in an opposition direction to drilling assembly's rotation. This can be extremely damaging as the rate at which the drilling assembly 10 precesses is a multiple of the surface RPM. The roll rate is inversely proportional to borehole clearance but typically can be up 50× the surface RPM. The increase in cyclic stress rate is what causes whirl to be extremely damaging; it can significantly reduce fatigue life of drilling components.

As shown in FIG. 6, whirl can have a multiple-lobed or star pattern as the drilling assembly 10 encounters the borehole wall, slowing its RPM, and then rebounds with increased RPM. Whirl usually involves low spots in the RPM that occur when the downhole assembly 10 contacts the borehole wall. Shown here as five lobe whirl, other forms of bit whirl can involve any number of lobes or other characteristic.

During whirl, the average RPM over time would be what is expected from the drilling assembly 10 based on what RPM is imparted at the surface. However, the RPM downhole and the drilling assembly 10 suffer from intervals of high and low RPM that can damage components. As long as rotation is applied, whirl may continue once initiated, and an impediment, such as hard contact or stop, may be needed to interrupt it.

Lateral vibration can result in significant damage to the drilling assembly 10 and electronic components, especially when vibration amplitude results in the drilling assembly 10 impacting the borehole. Lateral vibration is any vibration in the transverse cross-section of the drilling assembly 10 or borehole. Typical measurements utilize a single accelerometer: however; this is significantly biased by radial acceleration while rotating. The arrangement of accelerometers in the sensor element 30 disclosed herein removes any rotational bias and gives the true lateral vibration measurement as if the sensors themselves were mounted directly to the centerline (C) of the drilling assembly 10.

E. Additional Embodiments

Figure 7A:
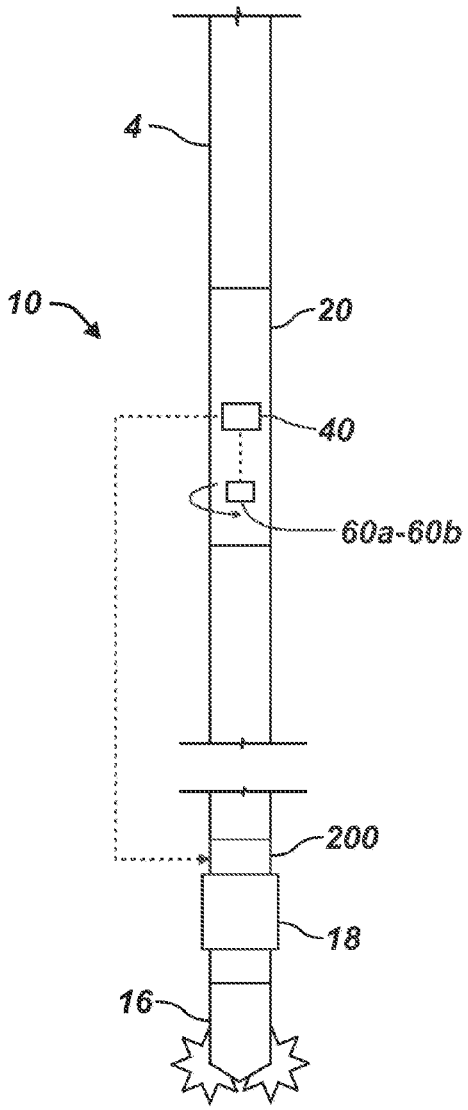
FIG. 7A illustrates a drilling assembly having a monitoring tool and a drilling interrupting mechanism.

As noted above, remedial actions can be performed during drilling to deal with detrimental vibrations when they occur. FIG. 7A illustrates a drilling assembly 10 having a monitoring tool 20 and a drilling interrupting mechanism 200. The processor 40 of the tool 20 obtains angular and linear motion measurements from the sensors (e.g., at least two accelerometer pairs 60*a-b*) and determines parameters indicative of detrimental vibration, such as whirl or torsional vibration, as disclosed herein. When detrimental vibration is determined, the processor 40 can then communicate a feedback signal to the drilling interrupting mechanism 200 to automatically interrupt the drilling performed by the drill bit 16. How the feedback signal is communicated depends on the type of mechanism 200 used and the other components of the drilling assembly 10. In general, the feedback signal can be communicated with an electrical signal, hydraulics, pressure pulse, or other known technique.

As shown in FIG. 7A, the mechanism 200 can be disposed downhole of the tool 20. Several types of mechanisms could be used. For example, the mechanism 200 can be a clutch, brake, or the like that can change the torque applied to the drill bit 16. Alternatively, the mechanism 200 can be an actuatable valve that alters the flow of drilling mud to affect the drilling operations, or the mechanism 200 can be an actuatable vibrator that vibrates the drill collar 20 of the assembly 10 to alter the drilling operations. One skilled in the art with the benefit of the present disclosure will appreciate that these and other types of mechanisms can be used to automatically alter the drilling operation based on a feedback signal from the tool 20.

In one example, the mechanism 200 can use a clutch or brake similar to features disclosed in U.S. Pat. Pub. No. 2011/0108327 and U.S. Pat. Nos. 3,841,420; 3,713,500; and 5,738,178, which are incorporated herein by reference. In general, the clutch/brake mechanism 200 can be disposed in the mud motor 18 of the assembly 10, but can be disposed at other positions within the motor-drill bit drive train.

The clutch/brake mechanism 200 can use a plain brake, a hydraulic multidisc clutch, or a hysteresis clutch located within the motor-bit drive train or within the drill string 4 above the motor 18. The processor 40 of the tool 20 cooperates with the clutch/brake mechanism 200 to activate during rotation of the assembly 10 when detrimental vibrations occur. This results in a variation in rotational speed of the drill bit 16, thereby altering drilling parameters to counteract or deter the detrimental vibration.

In another example, the mechanism 200 can include a drilling fluid variable bypass orifice that controls the flow of drilling fluid through the mud motor 18 similar to that disclosed in incorporated U.S. Pat. Pub. No. 2011/0108327. The mechanism 200 can be disposed above the mud motor 18, within the mud motor 18, or elsewhere on the assembly 10. Variation in fluid flow through the bypass orifice of the variable orifice mechanism 200 results in a corresponding variation in the rotational speed of the drill bit 18. Accordingly, the processor 40 of the tool 20 cooperates with the variable orifice mechanism 20 when detrimental vibrations occur to activate during rotation of the assembly 10 and alter drilling parameters.

Figure 7B:
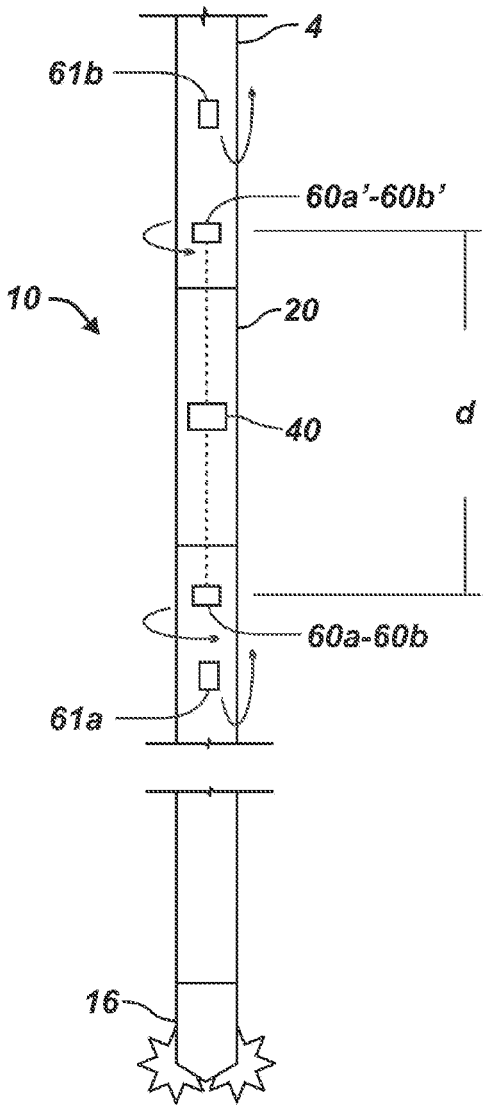
FIG. 7B illustrates a drilling assembly having a monitoring tool and uphole and downhole sensors pairs.

FIG. 7B illustrates a drilling assembly 10 having a monitoring tool 20 and uphole and downhole at least two accelerometer pairs 60*a*-60*b* and 60*a*'-60*b*' displaced by a distance d on the assembly 10. The processor 40 of the tool 20 obtains angular and linear motion measurements from the displaced pairs 60*a*-60*b* and 60*a*'-60*b*'. Comparing the angular and linear motion measurements, the processor 40 can then determine further characteristics of the torsional vibration, bending, or twisting of the assembly 10 during drilling. In the end, the compared measurements can give a more comprehensive view of the torsional vibration of the assembly 10.

The displacement d of the pairs 60*a*-60*b* and 60*a*'-60*b*' can be configured for a particular implementation so that the torsional vibration can be determined over more or less of the length of the assembly 10 and the drillstring 4. Additionally, more than two such pairs 60*a*-60*b* and 60*a*'-60*b*' can be used for more comprehensive characterization.

To make further characterizations of the assembly's vibration, other uphole and downhole angular rate sensors 61*a* and 61*b* can be displaced on the assembly 10. These sensors 61*a*-*b* can be angular rate gyroscopes or can be at least two accelerometer pairs oriented to measure rotation of the assembly 10 along its longitudinal axis (i.e., to measure bending of the assembly 10). The processor 40 of the tool 20 obtains angular rate measurements from these displaced sensors 61*a*-*b* and compares the measurements to determine characteristics of the vibration or bending of the assembly 10 during drilling.

As will be appreciated with the benefit of the present disclosure, these and other arrangements of at least two accelerometer pairs 60*a*-*b* can be used to measure the angular rate at various locations and in various planes along the drilling assembly 10 so that comparisons of the measurements can characterize the vibration of the assembly 10.

F. Concluding Remarks

As will be appreciated, teachings of the present disclosure can be implemented in electronic circuitry, computer hardware, computer firmware, computer software, or any combination thereof. Teachings of the present disclosure can be implemented in a computer program product tangibly embodied in a machine-readable storage device for execution by a programmable processor so that the programmable processor executing program instructions can perform functions of the present disclosure. The teachings of the present disclosure can be implemented advantageously in one or more computer programs that are executable on a programmable system including at least one programmable processor coupled to receive data and instructions from, and to transmit data and instructions to, a data storage system, at least one input device, and at least one output device. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole drilling vibration analysis method, comprising:

drilling with a drilling assembly by rotating the drilling assembly;

measuring acceleration with at least two accelerometer pairs oriented at a first orientation relative to one another on the drilling assembly, each of the at least two accelerometer pairs having at least two accelerometers oriented at a second orientation relative to one another;

compensating for angular bias associated with the measured acceleration by cancelling corresponding angular acceleration components of each of the accelerometers between the at least two accelerometer pairs;

determining motion of the drilling assembly with the compensated acceleration while drilling downhole, the determined motion at least including linear motion of the drilling assembly;

analyzing the determined motion; and determining that detrimental vibration is occurring during drilling based on the analysis.

2. The method of claim 1, wherein the determined motion further comprises angular motion of the drilling assembly.

3. The method of claim 1, wherein the determined motion comprises one or more of displacement, velocity, and acceleration of the drilling assembly.

4. The method of claim 1, wherein determining the motion of the drilling assembly further comprises measuring an angular rate with a gyroscope.

5. The method of claim 1, wherein measuring the acceleration with the at least two accelerometer pairs oriented at the first orientation relative to one another and the at least two accelerometers oriented at the second orientation relative to one another comprises measuring the acceleration in orthogonal X and Y directions both radially and tangentially relative to the drilling assembly.

6. The method of claim 1, wherein the first orientation comprises the at least two accelerometer pairs being oriented 90-degrees relative to one another on the drilling assembly.

7. The method of claim 6, wherein the second orientation comprises the at least two accelerometers in a given one of the pairs being oriented 90-degrees relative to one another.

8. The method of claim 6, wherein the second orientation comprises the at least two accelerometers in a given one of the pairs being oriented on a same side or on opposing sides of the drilling assembly.

9. The method of claim 1, wherein measuring the acceleration with at least two accelerometer pairs comprises:

measuring the acceleration with a first of the at least two accelerometer pairs, the first accelerometer pair having first and second accelerometers disposed at the second orientation relative to one another at a first radius from a center axis of the tool.

10. The method of claim 9, wherein the first and second accelerometers are disposed at substantially the same first radius from the center of the tool and are disposed on substantially a same axial plane.

11. The method of claim 9, wherein measuring the acceleration with the first accelerometer pair comprises:

determining a first X-component of the acceleration with the first accelerometer, the first X-component being tangential to the rotation of the tool; and determining a first Y-component of the acceleration with the second accelerometer, the first Y-component being orthogonal to the first X-component and being radial to the rotation of the tool.

12. The method of claim 11, wherein measuring the acceleration with the at least two accelerometer pairs comprises:

measuring the acceleration with a second of the at least two accelerometer pairs, the second accelerometer pair having third and fourth accelerometers disposed at the second orientation relative to one another at a second radius from the center axis of the tool.

13. The method of claim 12, wherein the second radius is substantially the same as the first radius.

14. The method of claim 12, wherein measuring the acceleration with the second accelerometer pair comprises:

determining a second X-component of the acceleration with the third accelerometer, the second X-component being radial to the rotation of the tool and being parallel to the first X-component; and determining a second Y-component of the acceleration with the fourth accelerometer, the second Y-component being orthogonal to the second X-component, being parallel to the first Y-component, and being tangential to the rotation of the tool.

15. The method of claim 1, wherein determining the motion of the drilling assembly with the measured acceleration while drilling downhole comprises determining the motion with axially displaced sets of the at least two accelerometer pairs displaced from one another along the central axis while drilling with the drilling assembly.

16. The method of claim 15, wherein determining that detrimental vibration is occurring during drilling based on the analysis comprises determining an aspect of at least one of bending or twisting of the drilling assembly by comparing the determined motion from the axially displaced sets of the at least two accelerometer pairs.

17. The method of claim 1, further comprising changing one or more operating parameters of the drilling assembly based on the determined detrimental vibration.

18. The method of claim 17, wherein changing the one or more operating parameters of the drilling assembly comprises:

changing one or more of weight on bit, rotational speed, torque, pump rate, mud flow rate, and mud motor operation; or operating a drilling interrupting mechanism on the drilling assembly based on the determined detrimental vibration.

19. The method of claim 1, wherein analyzing and determining comprises:

at least partially processing the determined motion downhole at the drilling assembly; and communicating the at least partially processed motion from the drilling assembly to the surface.

20. The method of claim 1, wherein analyzing the determined motion comprises determining a pattern of vibration per one or more revolutions of the drilling assembly from the determined motion; and wherein determining that detrimental vibration is occurring during drilling based on the analysis comprises determining a severity measure of the detrimental vibration based on one or more aspects of the determined pattern.

21. The method of claim 1, wherein analyzing the determined motion comprises determining one or more cycles of an increase in the determined motion per one or more revolutions of the drilling assembly; and wherein determining that detrimental vibration is occurring during drilling based on the analysis comprises calculating a vibration measure, indicative of the detrimental vibration, based on a number of the one or more cycles or based on an amplitude of the one or more cycles.

22. The method of claim 1, wherein analyzing the determined motion comprises determining vibration over revolutions over time of the drilling assembly; and wherein determining that detrimental vibration is occurring during drilling based on the analysis comprises calculating a vibration measure, indicative of the detrimental vibration, based on a frequency of the vibration over the revolutions over time of the drilling assembly.

23. The method of claim 1, wherein analyzing the determined angular data comprises determining maximum angular velocity over time, minimum angular velocity over time, and average angular velocity over time; and wherein determining that detrimental vibration is occurring during drilling based on the analysis comprises calculating a measure relating the maximum angular velocity over time, the minimum angular velocity over time, and the average angular velocity over time.

24. A downhole drilling vibration analysis method, comprising:

drilling with a drilling assembly by rotating the drilling assembly;

measuring acceleration in orthogonal X and Y directions both radially and tangentially relative to the drilling assembly using a plurality of accelerometers disposed on the drilling assembly;

compensating for angular bias associated with the measured acceleration by cancelling corresponding angular acceleration components between pairs of the accelerometers;

determining motion of the drilling assembly with the compensated acceleration while drilling downhole, the determined motion at least including linear motion of the drilling assembly;

analyzing the determined motion; and determining that detrimental vibration is occurring during drilling based on the analysis.

25. A downhole vibration analysis method, comprising:

obtaining acceleration measured downhole with at least two accelerometer pairs disposed on a downhole assembly, the at least two accelerometer pairs oriented at a first orientation relative to one another on the downhole assembly, each of the at least two accelerometer pairs having at least two accelerometers oriented at a second orientation relative to one another;

compensating for angular bias associated with the measured acceleration by cancelling corresponding angular acceleration components of each of the accelerometers between the at least two accelerometer pairs;

determining motion of the downhole assembly with the measured compensated acceleration, the determined motion at least including linear motion of the drilling assembly;

analyzing the determined motion; and determining that detrimental vibration has occurred downhole based on the analysis.

26. A drilling assembly, comprising:

a drill collar disposed on a drill string;

at least two accelerometer pairs disposed on the drill collar and measuring acceleration downhole while drilling with the drilling assembly, the at least two accelerometer pairs oriented at a first orientation relative to one another on the drill collar, each of the at least two accelerometer pairs having at least two accelerometers oriented at a second orientation relative to one another; and processing circuitry in communication with the at least two accelerometer pairs, the processing circuitry configured to:

cancel corresponding angular acceleration components of each of the accelerometers between the at least two accelerometer pairs to compensate for angular bias associated with the measured acceleration, determine motion of the drilling assembly with the compensated acceleration while drilling downhole, the determined motion at least including linear motion of the drilling assembly, analyze the determined motion, and determine that detrimental vibration is occurring during drilling based on the analysis.

27. The assembly of claim 26, wherein a first of the at least two accelerometer pairs comprises first and second accelerometers arranged at the second orientation relative to one another at a first radius from a central axis of the drill collar.

28. The assembly of claim 27, wherein:

the first accelerometer provides acceleration data related to a first X-component of the acceleration, the first X-component being tangential to the rotation of the tool; and the second accelerometer provides acceleration data related to a first Y-component of the acceleration, the first Y-component being orthogonal to the first X-component and being radial to the rotation of the tool.

29. The assembly of claim 28, wherein a second of the at least two accelerometer pairs comprises third and fourth accelerometers arranged at the second orientation relative to one another at a second radius from the central axis of the drill collar.

30. The assembly of claim 29, wherein:

the third accelerometer provides acceleration data related to a second X-component of the acceleration, the second X-component being radial to the rotation of the tool and being parallel to the first X-component; and the fourth accelerometer provides acceleration data related to a second Y-component of the acceleration, the second Y-component being orthogonal to the second X-component, being parallel to the first Y-component, and being tangential to the rotation of the tool.

31. The assembly of claim 29, wherein the second radius is substantially the same as the first radius.

32. The assembly of claim 26, wherein the processing circuitry comprises first circuitry disposed on the drill collar.

33. The assembly of claim 26, wherein the processing circuitry comprises second circuitry disposed at the surface.

34. The assembly of claim 26, further comprising telemetry unit communicating information indicative of the detrimental vibration from the drill collar to the surface.

35. The assembly of claim 26, further comprising a mechanism disposed on the drilling assembly and operable to interrupt drilling by the assembly.

* * * * *